United States Patent [19]

Wang

[11] Patent Number: 4,582,307

[45] Date of Patent: Apr. 15, 1986

[54] C-CLAMP

[76] Inventor: Jinn-Yih Wang, No. 4, Lane 249, Pei Ning Rd., Hao Hsiu Li, Homei Chen, Chunghua Hsien, Taiwan

[21] Appl. No.: 704,349

[22] Filed: Feb. 22, 1985

[51] Int. Cl.[4] ..... B25B 1/02

[52] U.S. Cl. ..... 269/182; 269/249

[58] Field of Search ..... 269/249, 181, 182

[56] References Cited

U.S. PATENT DOCUMENTS 2,461,687 2/1949 Hopfeld ..... 269/182

2,546,906 3/1951 Susgen et al. ..... 269/182

*Primary Examiner*—Robert C. Watson

*Attorney, Agent, or Firm*—Townsend and Townsend

[57] ABSTRACT

The c-clamp includes a C-shaped body and a screw which can adjustably penetrate through an end of the C-shaped body to clamp or release an object placed between a free end of the screw and the other end of the C-shaped body, a controlling member mounted pivotally with respect to the C-shaped body and provided with a threaded surface which can be rotated pivotally to engage or disengage with the screw, whereby one can determine a fast operation mode or a normal operation mode of the c-clamp.

6 Claims, 8 Drawing Figures

C-CLAMP

BACKGROUND OF THE INVENTION

This invention relates to a general-purpose c-clamp and particularly concerns an improved structure of a c-clamp.

As shown in FIG. 1, the conventional c-clamp has a C-shaped member 10 having one end provided with a threaded hole 12, and the other end made with a flat surface 14. The threaded hole 12 permits a long flat-ended screw 16 to thread through for clamping an article between its flat end 160 and the flat surface 14 of the C-shaped member 10. However, the adjustment of this type of clamp can only be carried out by screwing the screw 16. Since the speed of the screw moving relative to the C-shaped member is limited by the pitch of threads, the operation of the conventional c-clamp is inconveniently slow.

SUMMARY OF THE INVENTION

Therefore, the general object of this invention is to provide an improved c-clamp which can be operated at a faster speed.

It is another object of this invention to provide a c-clamp with a construction capable of clamping things exactly.

With the above objects in view, this invention provides a c-clamp which obviates the inconvenience encountered hitherto, the structure of which commprises a C-shaped body having two open ends, one of the open ends being provided with a tubular portion; a screw with an external thread capable of axially threading through the tubular portion for pressing the clamped material against the other end; and a controlling member mounted with the C-shaped member in such a manner that it can pivot about an axis transverse to the screw, and also including a threaded surface which is normally biased to the screw capable of engaging with the external thread of the screw when pivoted in a direction toward the screw, and capable of disengaging with the screw when pivoted away from the screw.

BRIEF DESCRIPTION OF THE DRAWINGS

The presently preferred examplary embodiment will be described in detail with respect to the following drawings, wherein.

DETAILED DESCRIPTION OF THE PREFERRED EMBODIMENTS

Figure 1:
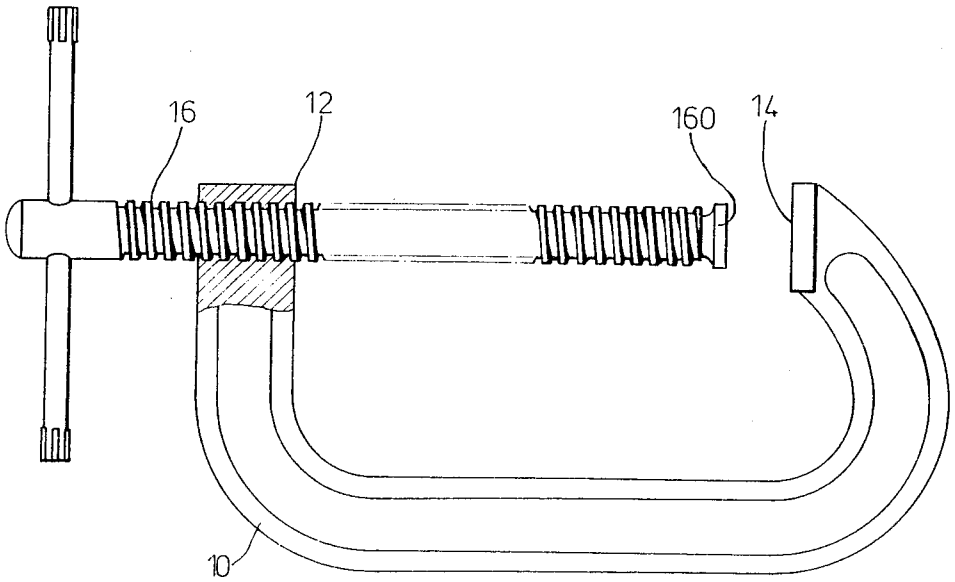
FIG. 1 PRIOR ART
FIG. 1 is a side view of a conventional c-clamp, with a portion thereof shown in section.
Figure 2:
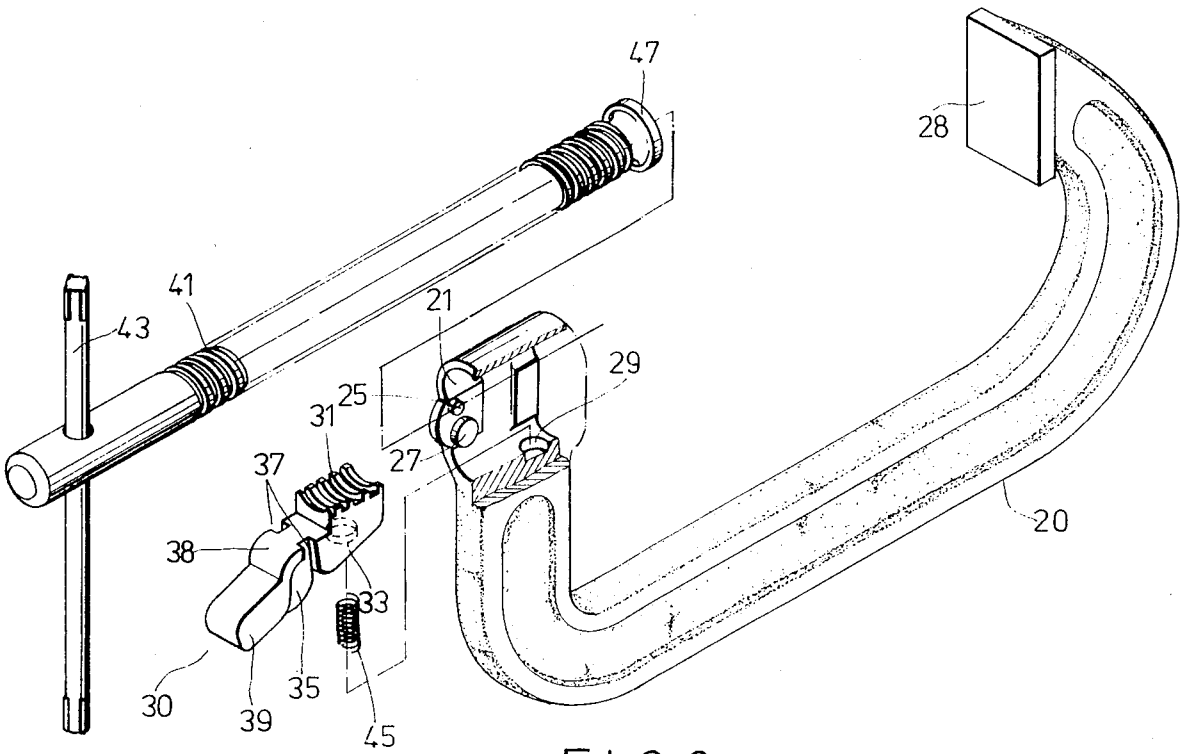
FIG. 2 is a fragmentary exploded view showing a c-clamp of a preferred embodiment according to this invention.
Figure 3:
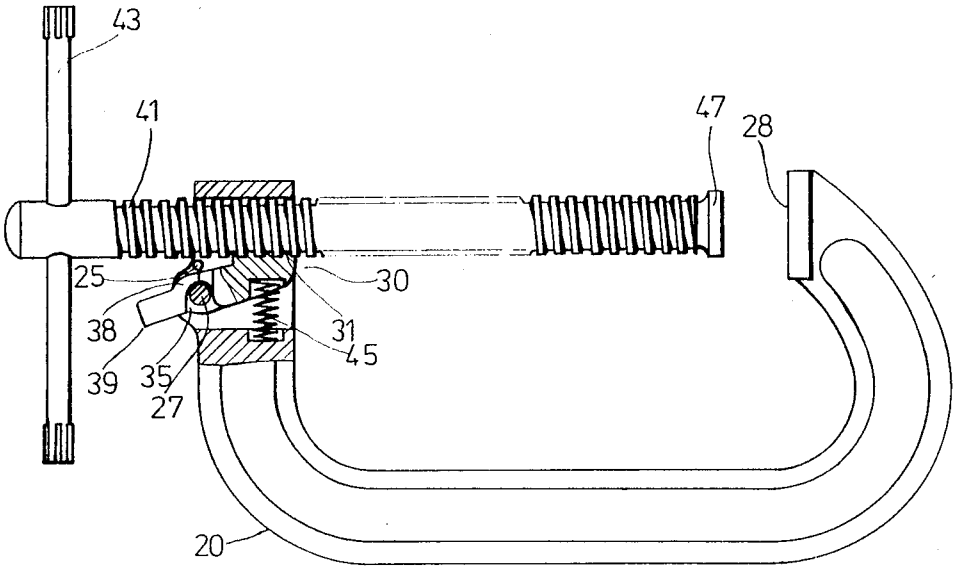
FIG. 3 is a side view of the embodiment as shown in FIG. 2, with a portion shown in section.

Referring first to FIG. 2, the improved c-clamp has a C-shaped body member 20, and a screw 41, which is similar to the conventional ones including a flattened end 47, which passes one end of the body member 20 to press the object (not shown) against the other end thereof. There is a flat anvil 28 integrally formed on one end of the C-shaped body member 20 by which an exact clamping effect can be obtained.

A tubular portion 21 is formed on the other end of the C-shaped member 20 and permits the screw 41 to pass through. In FIG. 2, for the benifit of illustration, a section of the material of the tubular portion 21 is cut away, and it can be seen that a boss 27 is formed on the interior side wall of the tubular portion and a stop pin 25 is formed at a slightly higher position above the boss 27, and though it is not shown in the Figures, it should be appreciated that on the opposite side wall a similar boss and stop pin are also provided in an axial alignment relative to the projection 27 and stop pin 25. In addition, on the bottom surface there is a circular recess 29 provided for seating the lower end of a return spring 45.

A controlling member generally indicated by numeral 30 is provided to enable the screw 41 to move relative to the tubular portion 21, either at a normal or a rapid speed, depending upon the user's desire.

The controlling member 30 is formed with a grip 39 at one end, while on the opposite end there is a portion made with a threaded upper surface 31 for engaging with he exterior thread of the screw 41. The bottom surface of that portion is inclined at an angle to the threaded surface 31, and on it a circular recess 33, which corresponds to the circular recess 29 of the tubular portion 21 is formed for seating the upper end of the return spring 45.

On two sides of the controlling member 30, cavities 35, 35 are formed at the intermediate position thereof. The contour of the cavity 35 which can be more clearly seen in FIGS. 4 through 7 comprises a substantial bell shaped portion 35 and an upwardly extending portion 37 with a depth larger than that of the bell shaped portion 35. Such a contour enables the controlling member 30 to hang over and pivotally rotate about the boss 27 in a clockwise or counterclockwise direction, or in a direction toward or away from the screw 41, with the bell shaped portion 35 engaged over the boss 27 such that the threaded surface 31 can be engaged or disengaged with the exterior thread of the screw 41.

Figure 5:
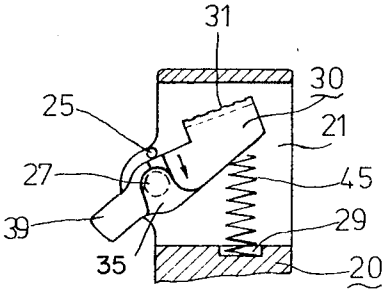
FIG. 5 is a schematic view showing the controlling member within the chamber when it has been mounted into position.

The assembling of the controlling member 30 and the C-shaped body member 20 is illustrated in FIGS. 4 through 7. Firstly, place the front end of the controlling member 30 into the tubular portion 21, then insert the lower end of the return spring 45 into the circular recess 29, and press the controlling member 30 to a position where the curved edges of the bell shaped portion 35 are partially retained over the boss 27, and thereafter, with a slightly counterclockwise twisting displacement, the stop pin 25 is abutted with the upper arcuate surface 38, and the controlling member 30 is biased to an inclined position within the tubular portion 21 under the action of the return spring 45, as shown in FIG. 5.

Figure 6:
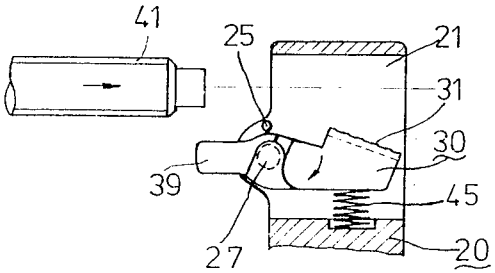
FIG. 6 is a schematic view showing the mounting of a screw with respect to the C-shaped member.
Figure 7:
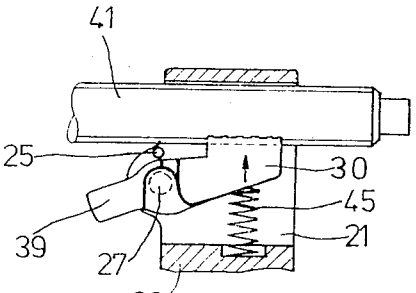
FIG. 7 is a schematic view showing the relative position of the screw and the C-shaped member when they have been assembled.
Figure 4:
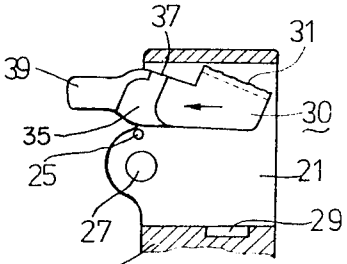
FIG. 4 is a schematic view showing the controlling member when inserted into a chamber formed on one end of the C-shaped member.

As illustrated in FIG. 6, when mounting the screw 41 with the C-shaped body member 20, the grip 39 of the controlling member 30 should be pulled upwards to lever down the return spring 45, and the axial hole of the tubular portion 21 thus is cleared so as to receive the screw 41 through it. When the screw 41 is threaded through the axial hole, the grip 39 can be released from pulling so that the threaded surface 31 will be biased to engage with the screw 41 with a pivotal movement of the controlling member 30. It can be appreciated that the return spring 45 will ensure the interengagement of the screw 41 and the threaded surface 31. In this position as shown in FIG. 7, if the screw 41 is desired to quickly pass through the tubular portion 21 so that the object placed between the anvil 28 and the flatted end 47 can be rapidly clamped or released, the user can press down the grip 39 to disengage the threaded surface 31 from the screw 41 and provide a passage for the screw 41 to pass through without obstructions. Alternatively, if the fast operation mode is not needed, one may screw the screw 41 forward or backward to clamp or release the object by the normal method.

There is a cross bar 43 transverse to the screw 41 as a handle for adjustment of the clamp.

Figure 8:
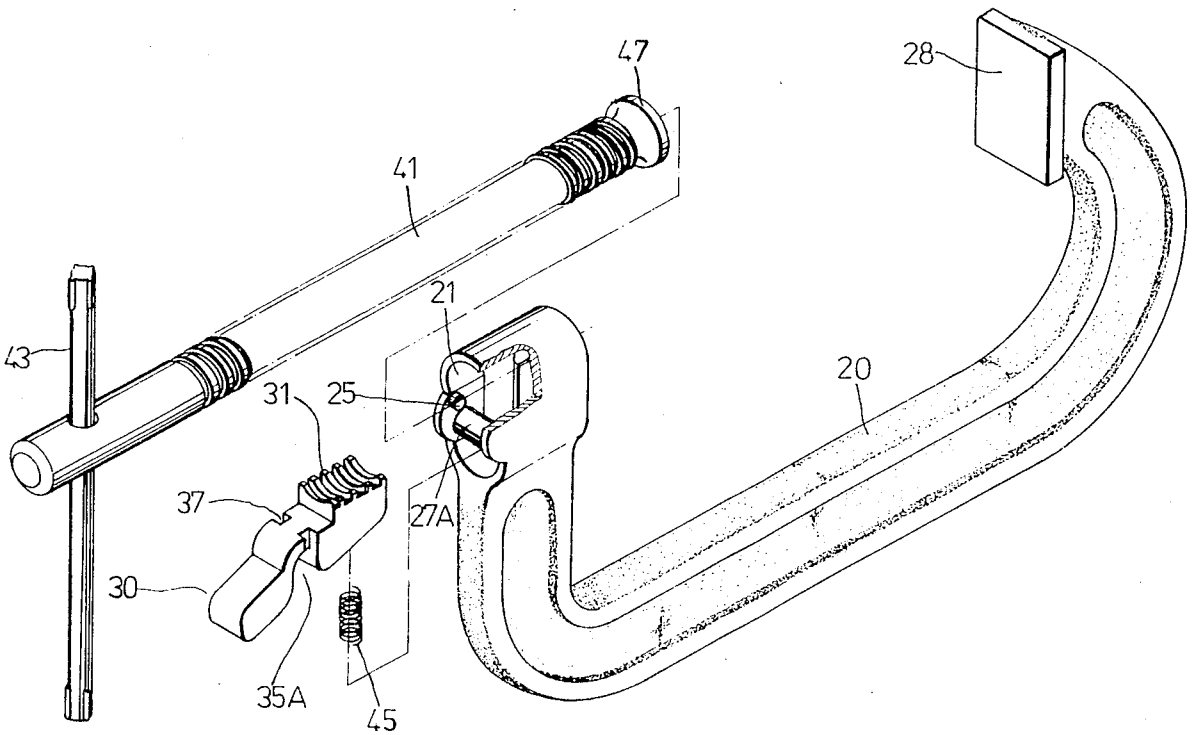
FIG. 8 is a fragmentary exploded view showing a c-clamp of a second embodiment according to this invention.

A second embodiment of this invention is shown in FIG. 8, in this embodiment the substantial bell shaped portion is replaced by a substantial bell shaped cut-out 35A which is extended over the width direction of the controlling member 30, with respect to the C-shaped body member 20, and the pair of bosses 27 are substituted by a shaft 27A extending between the opposite side walls of the tubular portion 21. The controlling member 30 is pivotally carried on the shaft 27A to achieve the same function as that in the preceding embodiment.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modification and equivalent structures.

I claim:

1. An improved c-clamp comprising:

a C-shaped body having two ends, a first end terminating in a tubular opening, and a second end terminating in an anvil and means defining a generally cylindrical protrusion extending into the tubular opening and oriented generally transversely to the opening;

a screw with external thread capable of axially threading through said tubular portion for pressing the clamped workpiece against said anvil; and a controlling member mounted into said tubular portion of said C-shaped body and having a channel arranged to engage the protrusion defining means, the channel being open in a generally radial direction and including a channel base, whereby said controlling member can be engaged with the protrusion defining means by moving it relative thereto in a radial channel direction until the channel base is in contact with said protrusion means, so that the member can pivot about an axis transverse to said screw, said controlling member further including a threaded surface, means normally pivotally biasing the member into engagement with said external thread of said screw, whereby the member can be disengaged from said screw when pivoted away from said screw.

2. The c-clamp of claim 1, wherein said protrusion defining means comprises a pair of axially aligned, spaced apart bosses on opposite sides of said tubular portion, and wherein said channel of said controlling member further comprises a pair of channel segments on opposite sides of said member separated by a wall, whereby said channel segments rotatively engage said bosses.

3. The c-clamp of claim 1, wherein said protrusion defining means comprises a shaft extending from one side of said tubular portion to the other, and wherein said channel of said controlling member is continuous from one side of said member to the other.

4. An improved c-clamp including a C-shaped body having two ends, one of said ends having a flat face, and the other having a tubular portion the axis of which is perpendicular to said first flat face, a clamping screw capable of passing through said tubular portion axially, a controlling member which is pivotally mounted in said tubular portion about a pivot axis perpendicular to the axis of said tubular portion and which has a threaded surface normally upwardly biased to engage with said screw, said controlling member being manually operable to disengage from said screw, the improvement comprising:

said controlling member further comprising an indentation means which has a bell-shaped cross-section in a plane perpendicular to said pivot axis and which engages with said pivot axis pivotally, and a stop pin projecting from the inner surface of said tubular portion in the direction along said pivot axis and at a location above said pivot axis to engage with the upper side of said controlling member, said identation means being open at the bottom side of said controlling member, whereby the mounting of the controlling member in the tubular portion is facilitated.

5. The c-clamp of claim 4, wherein said indentation means includes two cavities provided on two opposite sides of said controlling member, and said pivot axis is formed of two opposing cylindrical bosses projecting from the inner surface of said tubular portion into said cavities.

6. The c-clamp of claim 4, wherein said indentation means is a cutout that extends from one side to the other side of said controlling member, and said pivot axis forms a shaft which extends from one side to the other side of the inner surface of said tubular portion.

* * * * *